United States Patent [19]

Benasutti et al.

[11] 4,046,438

[45] Sept. 6, 1977

[54] VERTICAL SLIDING CLOSURE PANEL FOR REFRIGERATION DOOR

[75] Inventors: Louis D. Benasutti, Fairborn; Jerry L. Neubauer, Dayton, both of Ohio; Ronald E. Meyer, Troy, Mich.

[73] Assignee: General Motors Corporation, Detroit, Mich.

[21] Appl. No.: 718,754

[22] Filed: Aug. 30, 1976

[51] Int. Cl.[2] ..... A47F 3/00; E06B 3/00

[52] U.S. Cl. ..... 312/138 A; 49/415; 312/292; 312/306

[58] Field of Search ..... 312/138 A, 292, 247, 312/306, 307, 257 A; 49/414, 415, 421

[56] References Cited

U.S. PATENT DOCUMENTS

| | | | |
|---|---|---|---|
| 809,753 | 1/1906 | Segar | 49/421 |
| 1,214,602 | 2/1917 | Smith | 49/415 |
| 2,699,825 | 1/1955 | Stritzler | 49/414 |
| 3,851,939 | 12/1974 | Benasutti et al. | 312/138 A |

*Primary Examiner*—Paul R. Gilliam
*Assistant Examiner*—Alex Grosz
*Attorney, Agent, or Firm*—Edward P. Barthel

[57] ABSTRACT

A vertical sliding closure panel assembly for an appliance such as a refrigerator cabinet for closing a service area located on a food compartment door. The sliding closure panel has its edges formed with inwardly offset integral flanges defining vertical channels for reception of return flanges formed on the frame portions of the assembly providing passageways for the channels. The sliding panel has resilient clip members positioned on its side flanges operative to impart positioning stability so that the panel can be retained at any location between its fully open and fully closed position.

3 Claims, 8 Drawing Figures

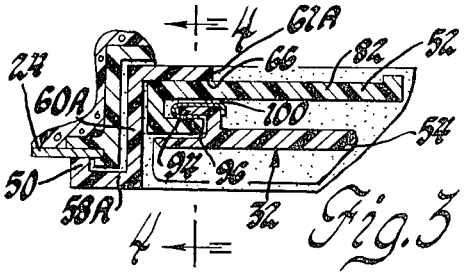
Fig. 3
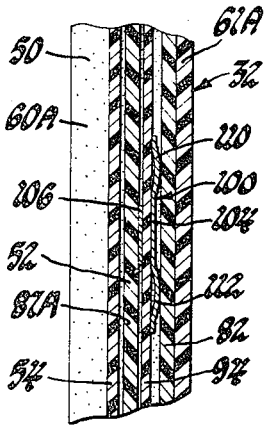
Fig. 4
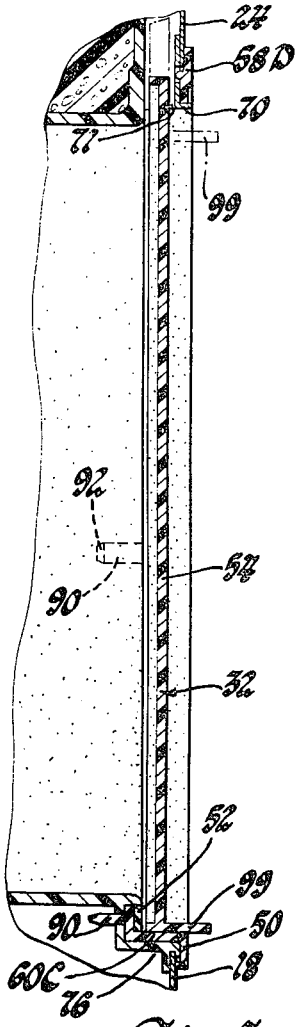
Fig. 5
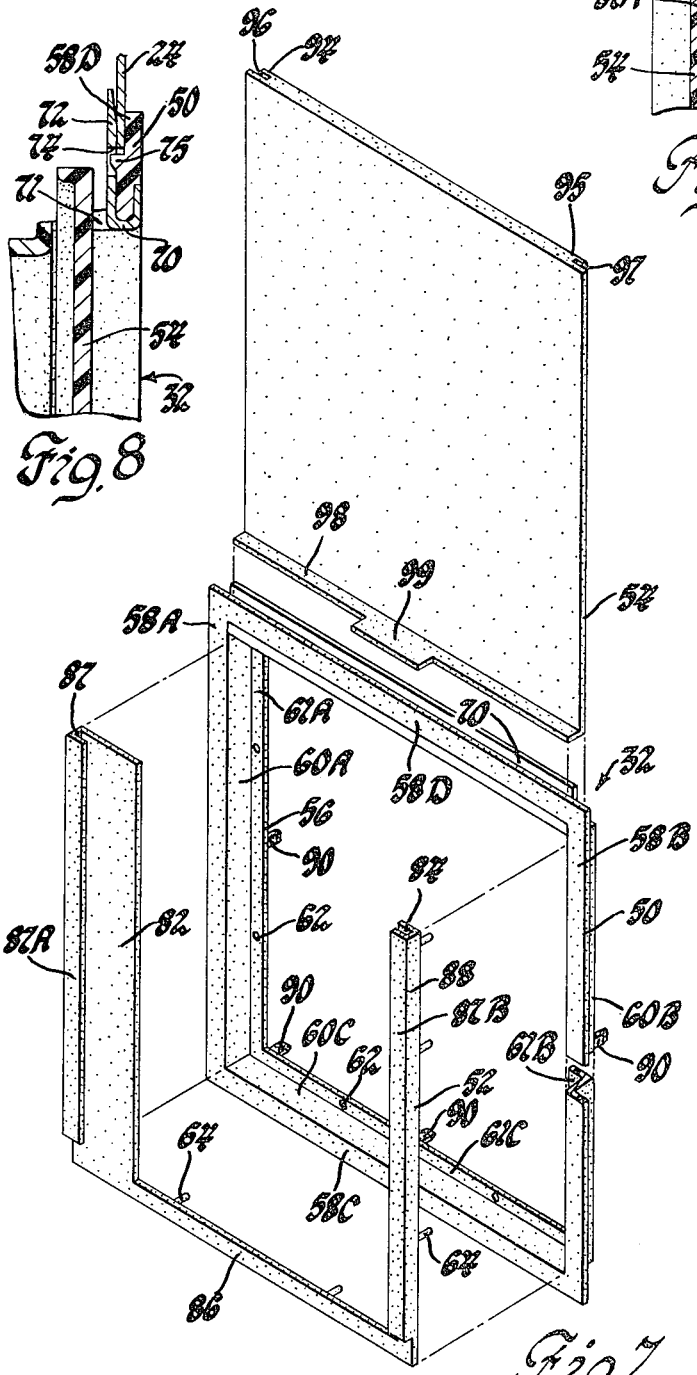
Fig. 8
Fig. 7
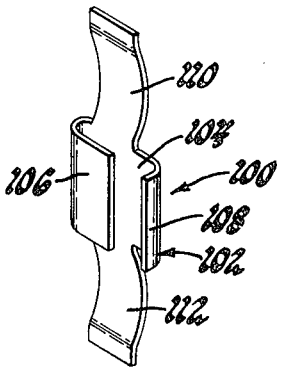
Fig. 6

VERTICAL SLIDING CLOSURE PANEL FOR REFRIGERATION DOOR

This invention relates to a cabinet sliding panel assembly and more particularly to a vertically sliding closure panel providing access to a recessed through-the-door service area in a refrigerator door.

In the recent development of locating ice and chilled beverage service areas on the exterior of a refrigerator door, it has been found preferably for both cleanliness and appearance to provide a closure panel member allowing the user to close off the service area when not in use. An example of one such closure panel is disclosed in U.S. Pat. No. 3,851,939 issued Dec. 3, 1974 to L. D. Benasutti and R. C. Reed, and assigned to the assignee of the present application. The Benasutti et al patent provides a horizontally slidable closure panel for a through-the-door service area opening for sliding the movable panel between its normally closed position and an open position behind an adjacent fixed panel.

It is an object of the present invention to provide an improved sliding panel assembly for providing access to a through-the-door service area in a refrigerator cabinet or the like, having a main frame section and a U-shaped sub-frame section mounted on the door outer shell, with the main frame having an inwardly directed around the periphery of the opening and the sub-frame having vertical side members with opposed return flanges coextensive therewith defining vertical guide rails for tracking an integral inner L-shaped flange on the closure panel inner face adjacent its side edges, defining channel passageways for the sub-frame guide rails guiding the panel during vertical movement between its lower closed position and its raised open position in which it underlies the door outer shell.

It is another object of the present invention to provide a vertically sliding panel assembly for closing the access opening to a through-the-door service area in a refrigerator cabinet or the like with the panel having side channels for movement within cooperating side rails on the panel frame portion, and wherein a plurality of resilient sheet metal clip members are provided for positioning on offset flanges defining the channels whereby the clip members provide smooth sliding movement of the panel in the frame, while imparting positioned stability thereto so that the panel can be resiliently retained in any desired vertical position.

Further objects and advantages of the present invention will be apparent from the following description, reference being had to the accompanying drawings wherein a preferred embodiment of the present invention is clearly shown.

In the Drawings:

FIG. 3 is an enlarged fragmentary horizontal sectional view taken of one side channel and flange shown in FIG. 2;

FIG. 4 is a fragmentary vertical sectional view taken along the line 4—4 of FIG. 3;

FIG. 5 is an enlarged fragmentary vertical sectional view taken on line 5—5 of FIG. 2;

FIG. 6 is an enlarged perspective view of spring retaining clip;

FIG. 7 is an exploded view of the panel assembly; and

FIG. 8 is an enlarged fragmentary sectional view of the upper portion of FIG. 5.

Figure 1:
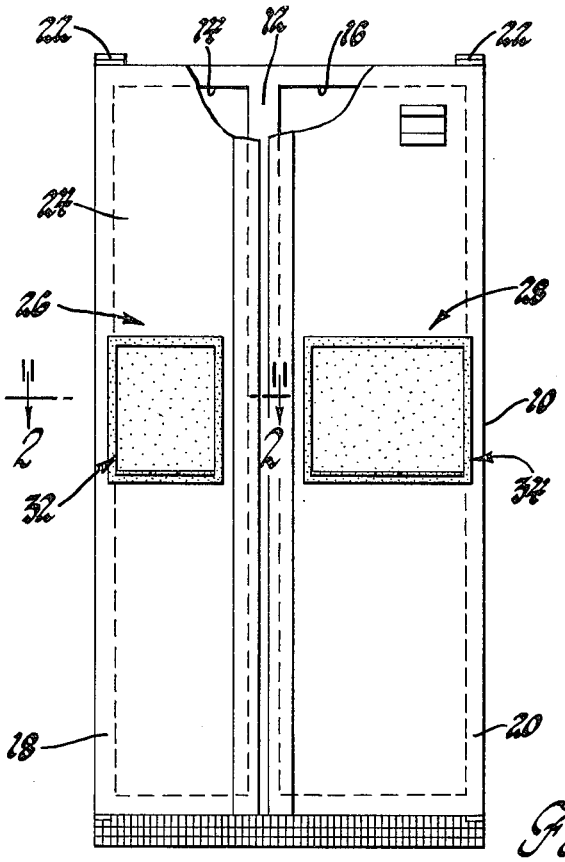
FIG. 1 is a front elevational view of a side-by-side refrigerator freezer cabinet incorporating the present invention.

Referring now to the drawings, there is shown in FIG. 1 a refrigerator cabinet 10 including two vertically extending compartments separated by a vertical partition 12. The cabinet comprises insulating walls including an insulated bottom wall with the insulated vertical partition 12 separating the cabinet volume into a freezer compartment 14 and a fresh food compartment 16 indicated by dashed lines in FIG. 1. The bottom wall separates these two compartments from the machinery compartment (not shown) which includes a suitable refrigeration system in the lower portion of the cabinet for maintaining the freezer compartment at sub-freezing temperatures and the fresh food compartment at above-freezing temperatures. The access openings to the two compartments 14 and 16 are closed by a freezer door 18 and a fresh food door 20, respectively, which are pivotally mounted on the face of the cabinet at their outer edges by means of suitable pivot hinges 22.

Figure 2:
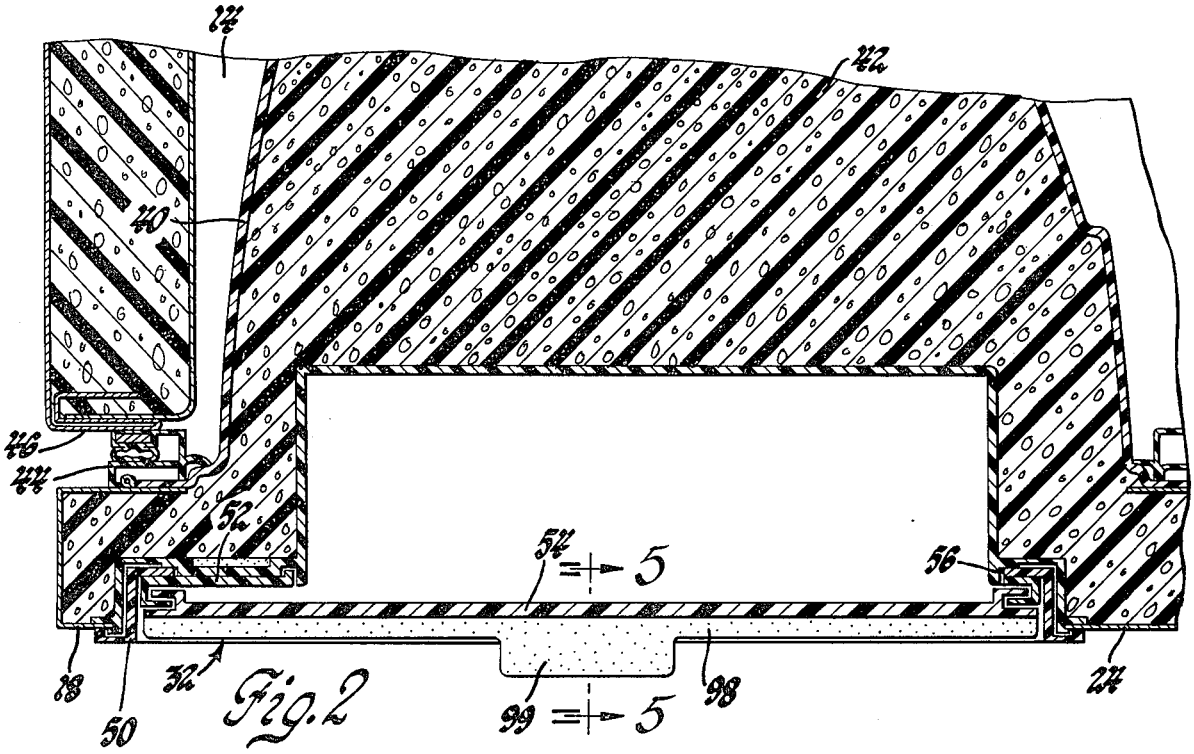
FIG. 2 is a horizontal sectional view taken generally along the line 2—2 of FIG. 1.

The access doors include an outer metal shell or wall, as shown at 24 in FIG. 2 for door 18 in which recessed compartments or service areas 26 and 28 is provided in the front or exterior surface of each of the doors 18 and 20 respectively. In the disclosed embodiment the compartment 26 in the freezer door 18 defines ice cube dispensing area for dispensing ice exteriorly of the cabinet while compartment 28 in the fresh food door 20 defines a service area for dispensing chilled beverages such as water or juice concentrate by depressing suitable actuator means (not shown). The ice cube dispensing portion of the freezer door service area is shown and described in U.S. Pat. No. 3,789,620 to Benasutti et al, while the water and juice dispensing portion in the service area 28 is shown and described in the U.S. Pat. No. 3,949,903, issued Apr. 13, 1976 to Benasutti et al. Both of the aforementioned patents are assigned to the same assignee as the instant application, the disclosures of which are incorporated by reference herein.

As vertically sliding closure panel assemblies 32 and 34 for the service areas 26 and 28 respectively, are substantially the same, only the sliding panel assembly 32 for the freezer door 18 will be described in detail. In the illustrated form of the invention shown in FIG. 2 of the drawings, the vertical sliding closure panel assembly 32 is mounted in the recessed area of the freezer door 18 so as to be substantially flush with the outer shell 24.

In accordance with the usual refrigerator cabinet construction the freezer door 18 is of a double wall construction including the outer panel 24, an inner panel plastic liner 40 with the space between these panels being filled with suitable heat insulating material, which in the preferred embodiment is foamed-in-place polyurethane plastic 42. The door 18 is of a size such that its peripheral edges overlie or overlap the face portion of the cabinet surrounding the freezer compartment access opening and a suitable gasket 44 is provided therearound for sealing the space between the door and the cabinet face portion 46.

As best seen in FIG. 7 the closure panel assembly 32, shown in an exploded, perspective view, includes a main frame section 50, a sub-frame section 52 and a slidable closure panel 54. In the preferred form both the main frame 50 and the subframe 52 are formed from plastic material such as ABS plastic. The main frame 50 has a rectangular open space 56 therethrough corresponding to the rectangular opening in the outer shell 24 of the door. The main frame 50 has a three-sided U-shaped flange body formed with a generally double-L cross-section connected by an upper cross face flange portion constituting outwardly directed vertical face flange portions 58A and 58B and a lower cross face flange portion 58C. The face flange defined on its upper side solely by an upper cross face flange portion 58D integrally connecting the upper ends of side portions 58A and 58B whereby a top passage or opening 71 is provided for the closure panel. Thus, the face flange portions 58A, 58B, 58C and 58D extend completely around the open space 56 and are adapted to overlie the front face of the door shell.

The main frame 50 has a three-sided or U-shaped base portion comprising vertical side portions 60A and 60B and a lower cross portion 60C each of which extend perpendicular to the outer face flange portions 58A, 58B and 58C, respectively. The main frame inner flange comprises vertically extending inwardly directed side portions 61A and 61B and a lower upwardly directed cross flange portion 61C. Each of the main frame portions 61A, 61B and 61C have apertures 62 adapted to receive integral studs 64 of the sub-frame 52 which are heat welded, as by sonic welding, to provide a flush interface 66 (FIG. 3) thereby defining an access opening of a size suitable to dispense ice, beverages, etc. The composite main frame and sub-frame 50 and 52 is removably secured within the door by means of a full length snap-in-place J-shaped clip 70 located in spaced relation along the upper face flange cross portion 58D.

Thus, the composite frame 50, 52 is readily inserted in the freezer door opening by first positioning the free end 72 of the J-shaped clip 70 on the inner face of the door shell 24. It will be noted in FIG. 8 that the clip 70 has apertures 74 which receive frame detents 75 to retain the clip 70 on the cross portion 58D. The J-shaped clip 70 resiliently receives the upper edge of shell 24 after which the lower base portion 60C is moved into position for support on shell flange 76 (FIG. 5).

As seen in FIG. 7, the sub-frame 52 has an upright U-shaped configuration substantially corresponding to the double-L sectioned U-shaped portion of main frame 50. The sub-frame 52 nests within the main frame 50 with its vertical leg members 82 and 84 substantially coextensive in length with the vertical flanges 61A and 61B of the main frame. The U-shaped sub-frame has a horizontally extending bottom cross member 86 while the sub-frame side members 82 and 84 have outer opposed return flanges 87 and 88 respectively, coextensive therewith defining vertically extending coplanar side rails 87A and 87B. The main frame 50 peripheral border includes integral anchor tabs 90 having tapered ends 92 which frictionally engage suitable grommets (not shown) positioned in apertures along the vertical edges of the rectangular opening in the outer shell of the freezer door 18.

As best seen in FIG. 7, the vertical sliding panel 54 has integral L-shaped left hand and right hand flanges 94 and 95 respectively, on its inner face adjacent its side edges defining channels or tracks 96 and 97 coextensive therewith. Each of the vertically extending, outwardly open tracks 96 and 97 are suitably dimensioned to receive the return flange rails 87A and 87B respectively, of the sub-frame providing guide tracks for guiding the panel 54 during vertical movement between its lower closed position and its raised open position in which it underlies a portion of the outer shell. The panel is preferably formed with an integral outwardly extending flange 98 having a central extension 99 which provides a grip or handle portion to allow ready grasping of the panel by the operator.

To attain smooth vertical travel of the closure panel 54 and also to hold the panel 54 in any position a plurality of resilient sheet metal clips are generally indicated at 100 in FIG. 6. In the disclosed form two clips are provided along each side of the panel. Each clip member 100 includes a body portion 102 having a substantially G-shape in cross section including a base 104 with a 180° return bend flange 106 and a right-angled bend 108. The clip base 104 has a pair of spring biasing fingers 110 and 112 laterally projecting therefrom, having an outwardly bowed or arcuate vertical section as seen in FIG. 4. In this manner the clip's return bend flange 106 receives the free end of one L-shaped panel flange 94 with the clip right-angled bend 108 resiliently engaging the stem of the L-shaped flange for positive retention thereon. Each of the clip spring biasing fingers 110 and 112 are positioned in resiliently biased location between its associated L-shaped panel flange 94 or 95 and the associated opposed outer face of the sub-frame vertical member, whereby the clips provide smooth vertical sliding movement of the panel while supporting positioned stability thereto so that the panel can be resiliently retained in any desired vertical position.

While the embodiment of the present invention as herein disclosed constitutes a preferred form, it is to be understood that other forms might be adopted.

We claim:

1. In a refrigerator cabinet having an insulated door for closing a compartment, said door comprising an outer shell and an inner liner with the space therebetween filled with insulation material, said door having a rectangular-shaped opening formed in said shell defining a recessed service area, a sliding panel assembly in said outer shell providing access to the service area, comprising in combination, a main frame section and a sub-frame mounted thereon, said main frame having an outwardly directed flange around the periphery of said opening, said sub-frame having a horizontally extending bottom cross member and a pair of vertically extending side members, said sub-frame section side members having outer opposed return flanges coextensive with said sub-frame side members defining vertical guide rails, a vertically sliding panel having inner L-shaped flanges on its inner face adjacent its side edges defining channels coextensive with its vertical side edges, said sub-frame guide rails positioned with their associated channels for guiding said panel during vertical movement between its lower closed position and its raised open position in which it underlies a portion of said outer shell, and a plurality of resilient sheet metal clips for positioning on said panel offset flanges, each said clip having body portion including a pair of spring biasing fingers, means on each said clip body portion resiliently engaging one of the panel L-shaped flanges for retention thereon, the clip spring fingers each formed with an arcuate bowed portion for resiliently biased location between its associated L-shaped flange and the opposed outer surface of said sub-frame adjacent side member, whereby the clips provide smooth sliding movement of said panel in said sub-frame while imparting positioned stability thereto so that said panel can be resiliently retained in any desired vertical position.

2. In a refrigerator cabinet having an insulated door for closing a compartment, said door comprising an outer shell and an inner liner with the space therebetween filled with insulation material, said door having a rectangular-shaped opening formed in said shell defining a recessed service area, a sliding panel assembly in said outer shell providing access to the service area, comprising in combination, a main frame and a U-shaped sub-frame mounted thereon, said main frame having an outwardly directed flange around the periphery of said opening, said sub-frame having a horizontally extending bottom cross member and a pair of vertically extending side members, said sub-frame side members having outer opposed return flanges coextensive with said sub-frame side members defining vertical guide rails, a vertically sliding panel having inner L-shaped flanges on its inner face adjacent its side edges defining channels coextensive with its vertical side edges, said sub-frame guide rails positioned within their associated channels for guiding said panel during vertical movement between its lower closed position and its raised open position in which it underlies a portion of said outer shell, and a plurality of resilient sheet metal clips for positioning on said panel offset flanges, each said clip having body portion being substantially G-shaped in section and a pair of spring biasing fingers projecting upwardly and downwardly, respectively from said body portion; said G-shaped body portion resiliently engaging one of the panel L-shaped flanges for retention thereon, the clip spring fingers each formed with an arcuate bowed portion for resiliently biased location between its associated L-shaped flange and the opposed outer surface of said sub-frame adjacent side member, whereby the clips provide smooth sliding movement of said panel in said sub-frame while imparting positioned stability thereto so that said panel can be resiliently retained in any desired vertical position.

3. In a refrigerator cabinet having an insulated door for closing a compartment, said door comprising an outer shell and an inner liner with the space therebetween filled with insulation material, said door having a rectangular-shaped opening formed in said shell defining a recessed service area, a sliding panel assembly in said outer shell providing access to the service area, comprising in combination, a rectangular main frame section and a U-shaped sub-frame section mounted thereon, means for permanently securing said main frame section and sub-frame together to form a composite frame, said main frame having a three-sided flange body including a base portion and side portions defining a double-L cross section, said main frame section having an outwardly directed face flange around the periphery of said opening, said face flange formed on three sides by the outwardly directed portions of said double-L flange body and on the upper side solely by an upper cross face flange whereby a top passage is defined, means for removably retaining said composite frame in said door rectangular opening, said U-shaped sub-frame section having a horizontally extending bottom cross member and a pair of vertically extending side members, said sub-frame section side members having outer opposed return flanges coextensive with said sub-frame side members defining vertical guide rails, a vertically sliding panel having integral inner L-shaped flanges on its inner face adjacent its side edges defining channels coextensive with its vertical side edges, said sub-frame guide rails positioned within their associated channels for guiding said panel during vertical movement through said top passage between its lower closed position and its raised open position in which it underlies a portion of said outer shell, and a plurality of resilient sheet metal clips for positioning on said panel offset flanges, each said clip having body portion being substantially G-shaped in section and a pair of spring biasing fingers projecting upwardly and downwardly, respectively from said body portion; said G-shaped body portion resiliently engaging one of the panel L-shaped flanges for retention thereon, the clip spring fingers each formed with an arcuate bowed portion for resiliently biased location between its associated L-shaped flange and the opposed outer surface of said sub-frame adjacent side member, whereby the clips provide smooth sliding movement of said panel in said sub-frame while imparting positioned stability thereto so that said panel can be resiliently retained in any desired vertical position.

* * * * *